US011771272B2

(12) United States Patent
Rolfs et al.

(10) Patent No.: US 11,771,272 B2
(45) Date of Patent: Oct. 3, 2023

(54) CONTAINER HAVING A PUSH-BUTTON ACTIVATED, POP-OPEN LID

(71) Applicant: Kimberly-Clark Worldwide, Inc., Neenah, WI (US)

(72) Inventors: Bryan Eliot Rolfs, Chicago, IL (US); Jeremy Thaddeus Gauger, Greenville, WI (US); Maggie VanderHeiden Berger, Appleton, WI (US); Amanda Ann Gantz, Greenville, WI (US); Heidi Ellen Gehrke, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/847,481

(22) Filed: Jun. 23, 2022

(65) Prior Publication Data

US 2022/0313031 A1 Oct. 6, 2022

Related U.S. Application Data

(63) Continuation of application No. 16/641,797, filed as application No. PCT/US2017/049646 on Aug. 31, 2017, now Pat. No. 11,399,672.

(51) Int. Cl.
*A47K 10/42* (2006.01)
*B65D 43/16* (2006.01)
(Continued)

(52) U.S. Cl.
CPC ..... *A47K 10/42* (2013.01); *B65D 43/169* (2013.01); *B65D 43/26* (2013.01); *B65D 47/088* (2013.01);
(Continued)

(58) Field of Classification Search
CPC ..... B65D 83/0805; B65D 83/0811; B65D 83/0835; B65D 45/22; B65D 75/5894;
(Continued)

(56) References Cited

U.S. PATENT DOCUMENTS 6,105,809 A 8/2000 Yamanaka
6,206,221 B1 3/2001 Bando et al.
(Continued)

FOREIGN PATENT DOCUMENTS

CA 2252215 A1 * 5/2000 ..... B65D 43/161
CN 1325283 A 12/2001
(Continued)

OTHER PUBLICATIONS

OXO TOT, "OXO TOT On-The-Go Wipes Dispenser with Diaper Storage Pouch (Green)", https://www.just4bb.com/wipes-holders/664-oxo-tot-on-the-go wipes-dispenser-with-diaper-storage-pouch-green.html.
(Continued)

*Primary Examiner* — Robert J Hicks
(74) *Attorney, Agent, or Firm* — Kimberly-Clark Worldwide, Inc.

(57) ABSTRACT

A container for dispensing product includes a housing having an interior space. A rigid flip top assembly is disposed on the housing, and includes a lever, a lid, and a flange. The lid covers a dispensing orifice when in a closed position. The lever has a first end and a second end, and the lid is connected to the flange at a hinge proximate the second end. The lever longitudinally extends over a fulcrum. When a force is applied to the lever proximate the first end, the lever pivots at the fulcrum about a pivot axis, and the second end of the lever moves the lid from the closed position toward an open position.

14 Claims, 15 Drawing Sheets

(51) Int. Cl.

| | |
|---|---|
| ***B65D 43/26*** | (2006.01) |
| ***B65D 47/08*** | (2006.01) |
| ***B65D 75/58*** | (2006.01) |
| ***B65D 83/08*** | (2006.01) |
| *A47K 10/32* | (2006.01) |

(52) U.S. Cl.
CPC ..... *B65D 75/5894* (2013.01); *B65D 83/0805* (2013.01); *A47K 2010/3266* (2013.01)

(58) Field of Classification Search
CPC .... B65D 75/58; B65D 43/164; B65D 43/169; B65D 43/163; B65D 43/16; B65D 43/26; B65D 47/088; B65D 47/0876; B65D 47/0857; B65D 47/08; A47K 10/421; A47K 10/42; A47K 2010/3266
USPC ..... 220/263, 264, 262, 284, 315, 326, 324, 220/827, 810, 836; 206/233
See application file for complete search history.

(56) References Cited

U.S. PATENT DOCUMENTS

| | | | |
|---|---|---|---|
| 6,394,298 | B1 | 5/2002 | Zaidman |
| 6,902,077 | B1 | 6/2005 | Tack et al. |
| 7,614,519 | B2 | 11/2009 | Krauth et al. |
| 7,621,420 | B2 | 11/2009 | Bandoh et al. |
| 8,567,638 | B2 | 10/2013 | Bandoh et al. |
| 8,844,745 | B2 | 9/2014 | Peters et al. |
| 2004/0079665 | A1 | 4/2004 | Mamiye |
| 2010/0122985 | A1 | 5/2010 | Peters et al. |
| 2013/0175271 | A1 | 7/2013 | Lim |
| 2015/0114984 | A1 | 4/2015 | Mehdizadeh |
| 2015/0114985 | A1 | 4/2015 | Mehdizadeh |
| 2016/0159534 | A1 | 6/2016 | Ujiie |
| 2017/0096265 | A1 | 4/2017 | Kieffer et al. |
| 2019/0039813 | A1 | 2/2019 | Simmons et al. |

FOREIGN PATENT DOCUMENTS

| | | | |
|---|---|---|---|
| CN | 1903666 | A | 1/2007 |
| CN | 101448710 | A | 6/2009 |
| CN | 101522540 | A | 9/2009 |
| CN | 201686246 | U | 12/2010 |
| CN | 102216171 | A | 10/2011 |
| CN | 205186838 | U | 4/2016 |
| CN | 206243733 | U | 6/2017 |
| JP | 2010089807 | A | 4/2010 |
| JP | 5280743 | B2 | 9/2013 |
| KR | 200473610 | Y1 | 7/2014 |
| KR | 200478494 | Y1 | 10/2015 |
| WO | 2000018654 | A1 | 4/2000 |

OTHER PUBLICATIONS

Funkybox, "FunkyBox Easy Wipe Dispenser Box Pink with Hearts", https://www.amazon.co.uk/FunkyBox-Easy-Dispenser-white-Hearts/dp/B004KPKVGY.

* cited by examiner

CONTAINER HAVING A PUSH-BUTTON ACTIVATED, POP-OPEN LID

RELATED APPLICATIONS

The present application is a continuation application and claims priority to U.S. patent application Ser. No. 16/641,797, filed on Feb. 25, 2020, which is a national-phase entry, under 35 U.S.C. § 371, of PCT Patent Application No. PCT/US17/49646, filed on Aug. 31, 2017, all of which are incorporated herein by reference.

BACKGROUND OF THE INVENTION

Consumer products, such as disposable wipes, are often sold in packages designed to both store and dispense the products. For example, disposable moist wipes are often sold in rigid tubs or flexible pouches that include a dispensing orifice through which to extract the wipes from the interior of the tub or pouch. A movable and resealable flap or lid typically covers the dispensing orifice, so that when a wipe is not being dispensed, the tub or pouch can be sealed to the outside environment to prevent moisture loss from the plurality of moist wipes housed therein.

Mechanisms for opening the flap or lid vary. In a common "push button" design, the lid is held closed via a latching mechanism. In the closed position, a compressed spring lies in tension against an undersurface of the lid. When an opening button is pressed, the latching mechanism releases the lid, and the compressed spring unloads its tension to throw the lid to an open position. Such "push button" opening mechanisms are a desirable and elegant design, delivering intuitive, simple, and reliable operation to a user of the moist wipes dispenser.

However, conventional spring-based push-button mechanisms suffer from a variety of deficiencies. First, the force of the compressed spring in the closed position can distort/deform the dispenser components over time, potentially compromising moisture retention and opening performance. The wall sections of the parts can be made thicker to address this, but that undesirably increase the cost of the polymer or other material used to make the parts. Second, most compressed spring systems require a certain amount of headspace to operate properly, often making it necessary to create a taller/thicker surrounding structure, driving up polymer cost, using more natural resources, and imparting an undesirable, bulkier appearance. Bigger and/or thicker parts also increase transportation and storage costs, and consumers frequently prefer thinner, lighter packages for portability, environmental, and style reasons. Finally, nearly all moist wipe dispensing packages on the market today are formed from rigid or flexible recyclable plastics, and the inclusion of a rubber, silicone, or metal spring component in the package structure complicates efforts to easily recycle the package material.

As a result, there is a need for an improved push-button dispensing package for consumer products.

SUMMARY OF THE INVENTION

In a first embodiment, the invention provides a container for storing and dispensing product. The container includes a housing for storing product, the housing defining an interior space, the housing having an inner surface generally facing toward the interior space, and an outer surface generally facing away from the interior space. The container includes a rigid flip top assembly having a longitudinal dimension and a transverse dimension, the assembly comprising a lever, a lid, and a flange, the flange being affixed to the outer surface of the housing, the lid covering a dispensing orifice when the lid is in a closed position. The lever has a first end and a second end, the lid being connected to the flange at a hinge proximate the second end, the lever extending in the longitudinal direction over a fulcrum. When a force is applied to the lever proximate the first end, the lever pivots at the fulcrum about a pivot axis, and the second end of the lever moves the lid from the closed position toward an open position.

In a second embodiment, the invention provides the container of the first embodiment wherein the lever is a ring lever.

In a third embodiment, the invention provides the container of either the first or second embodiment wherein, as the first end of the lever is moved from a rest position to a fully depressed position, the second end of the lever rotates less than 15 degrees about the pivot axis and the lid rotates at least 90 degrees about the hinge.

In a fourth embodiment, the invention provides the container of either the first or second embodiments wherein, as the first end of the lever is moved from a rest position to a fully depressed position, the second end of the lever rotates less than 10 degrees about the pivot axis, and the lid rotates at least 110 degrees about the hinge.

In a fifth embodiment, the invention provides the container of any of the first through fourth embodiments wherein the fulcrum is closer to the first end than to the second end.

In a sixth embodiment, the invention provides the container of any of the first through fifth embodiments wherein the fulcrum is integrally formed with the lever.

In a seventh embodiment, the invention provides the container of any of the first through sixth embodiments wherein the lid includes a catch, the catch adapted to engage a latch when the lid is in the closed position, and wherein when the force is applied to the ring lever proximate the first end, the second end of the ring lever forces the latch to pull away from the catch to move the lid from the closed position toward the open position.

In an eighth embodiment, the invention provides the container of any of the first through seventh embodiments wherein the latch is integrally formed with the ring lever.

In a ninth embodiment, the invention provides a container for storing and dispensing product. The container comprises a flexible pouch for storing product, the flexible pouch defining an interior space, the flexible pouch having an inner surface generally facing toward the interior space, and an outer surface generally facing away from the interior space. The container includes a rigid flip top assembly having a longitudinal dimension and a transverse dimension, the assembly comprising a lid and a push button. The lid includes a catch, the catch adapted to engage a latch when the lid is in a closed position. When a force is applied to the push button, the lid springs from the closed position toward an open position. The container includes no component made of rubber, silicone, elastomer, or metal.

In a tenth embodiment, the invention provides a container for storing and dispensing product. The container comprises a flexible pouch for storing product, the flexible pouch defining an interior space, the flexible pouch having an inner surface generally facing toward the interior space, and an outer surface generally facing away from the interior space. The container includes a rigid flip top assembly having a longitudinal dimension and a transverse dimension, the assembly comprising a lid and a push button. The lid includes a catch, the catch adapted to engage a latch when the lid is in a closed position. When the lid is in the closed position and the push button is in an un-depressed position, no component in the rigid flip top assembly has stored potential energy.

In an eleventh embodiment, the invention provides the container of either the ninth or tenth embodiment wherein the rigid flip top assembly further comprises a ring lever and a flange, wherein the ring lever has a first end and a second end, the lid being integrally connected to the flange at a hinge proximate the second end, the ring lever extending in the longitudinal direction over at least one fulcrum, and wherein, when the force is applied to the push button, the ring lever pivots at the fulcrum about a pivot axis such that the ring lever forces the latch to pull away from the catch to move the lid from the closed position toward the open position, and wherein the push button is integrally formed with the ring lever.

In a twelfth embodiment, the invention provides the container of any of the ninth through eleventh embodiments wherein the ring lever, the push button, and the at least one fulcrum collectively and integrally form a first component, and wherein the flange, the lid, and the hinge collectively and integrally form a second component, the rigid flip top assembly consisting of the first component and the second component.

In a thirteenth embodiment, the invention provides the container of any of the ninth through twelfth embodiments wherein the flange is affixed to the outer surface of the pouch, and wherein the ring lever and the flange encircle a dispensing orifice through which the product can be withdrawn from the interior space.

In a fourteenth embodiment, the invention provides the container of any of the ninth through thirteenth embodiments wherein as the force is applied to the push button, potential energy builds in the lever while the catch holds the latch in the closed position, and when the latch pulls away from the catch, the potential energy is converted to kinetic energy to cause the lid to spring from the closed position toward the open position.

In a fifteenth embodiment, the invention provides the container of any of the first through fourteenth embodiments wherein the rigid flip top assembly consists of polymer selected from the group of polyethylene terephthalate, polyethylene, and polypropylene.

In a sixteenth embodiment, the invention provides the container of any of the first through fifteenth embodiments wherein an entirety of the rigid flip top assembly is disposed outwardly of a dispensing orifice through which the product can be withdrawn from the interior space.

In a seventeenth embodiment, the invention provides the container of any of the first through sixteenth embodiments wherein the housing is a flexible pouch.

In an eighteenth embodiment, the invention provides the container of any of the first through seventeenth embodiments wherein the product comprises disposable personal care tissues or moist wipes.

BRIEF DESCRIPTION OF THE DRAWINGS

FIG. 10 representatively illustrates a side cross-section view taken along line X-X in the embodiment of FIG. 2, but with the lid being moved toward a closed position.

DETAILED DESCRIPTION OF PARTICULAR EMBODIMENTS

Figure 1A:
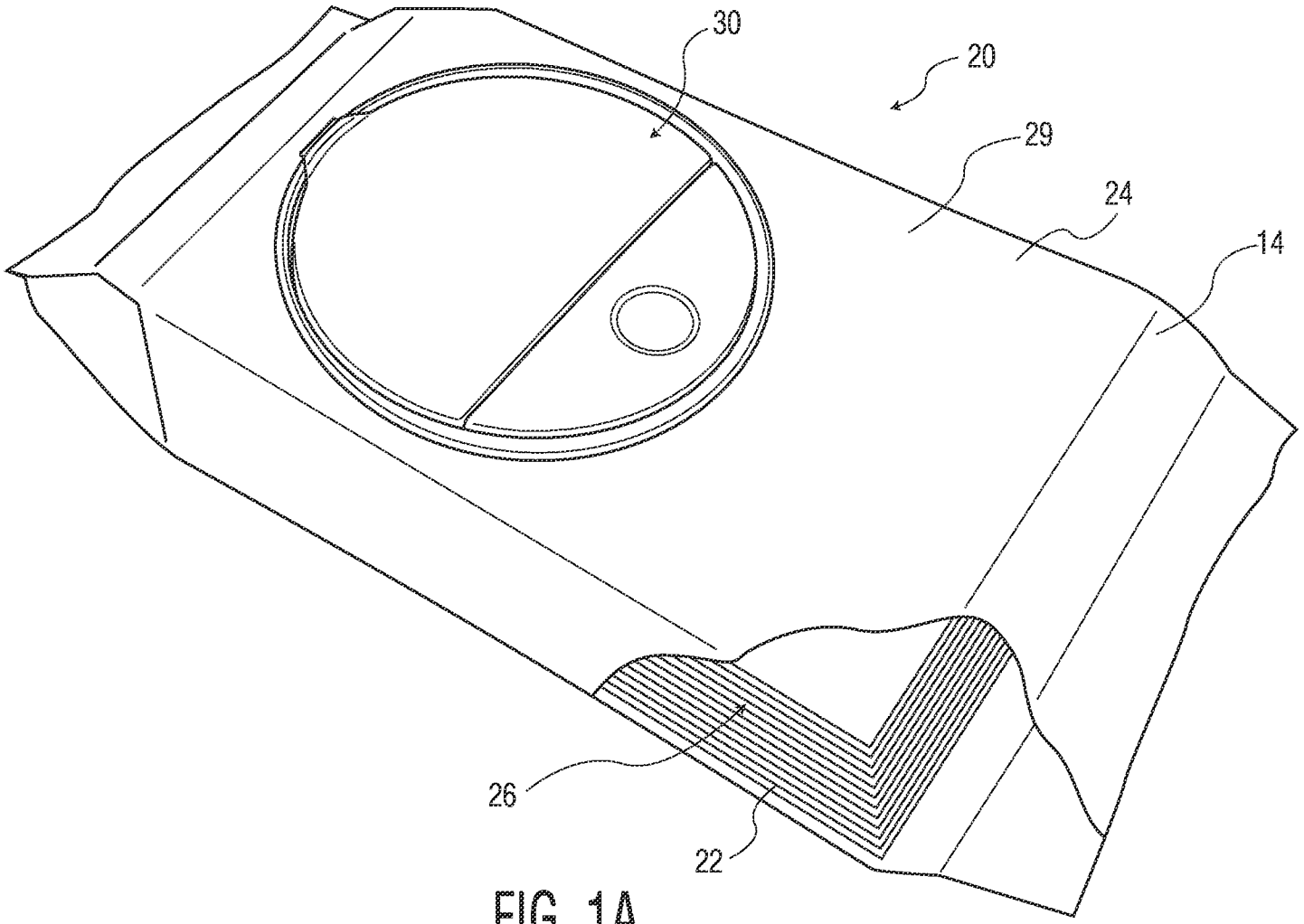
FIG. 1A representatively illustrates a perspective view of one embodiment of the container of the invention, shown with the lid shut.
Figure 1B:
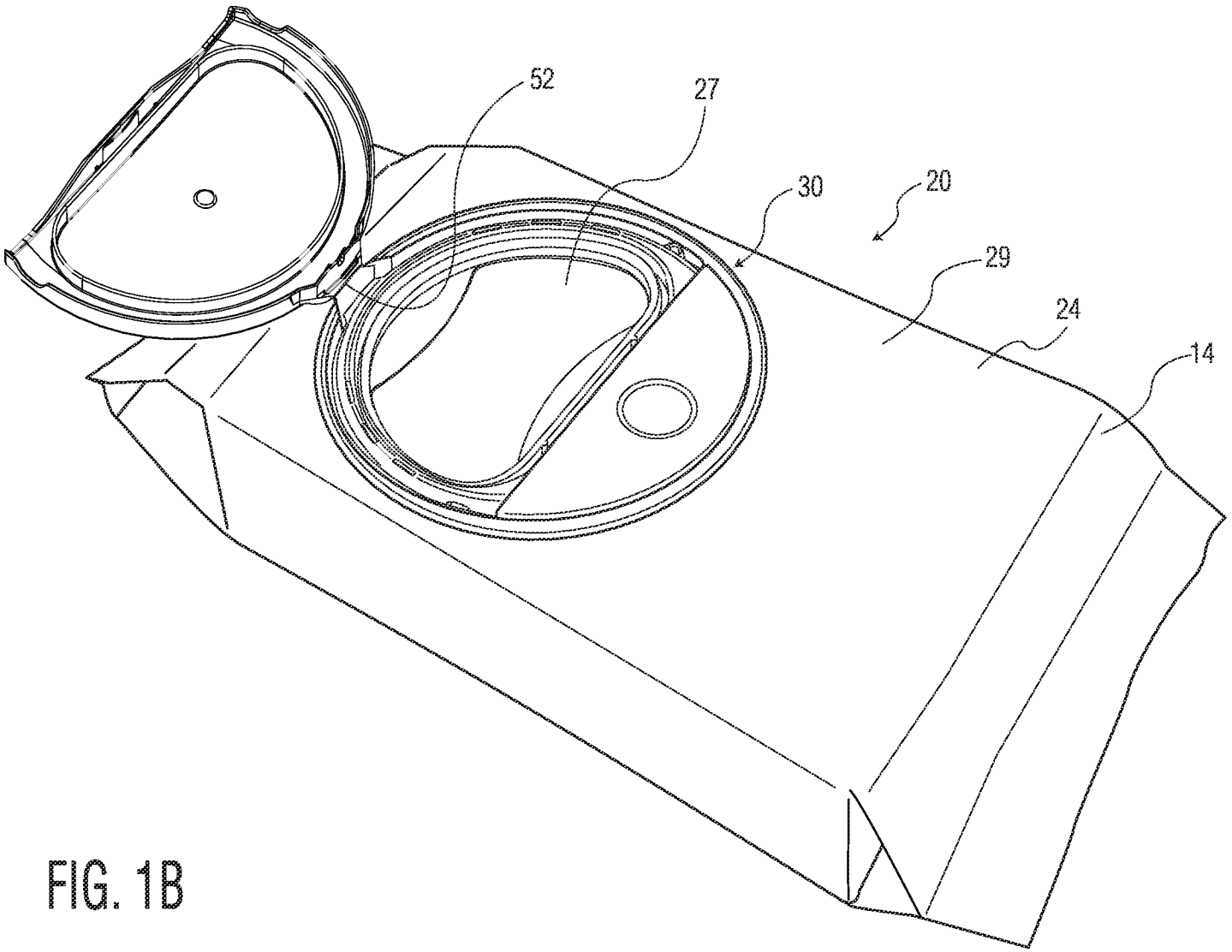
FIG. 1B representatively illustrates a perspective view of the embodiment of FIG. 1A, shown with the lid open.
Figure 1C:
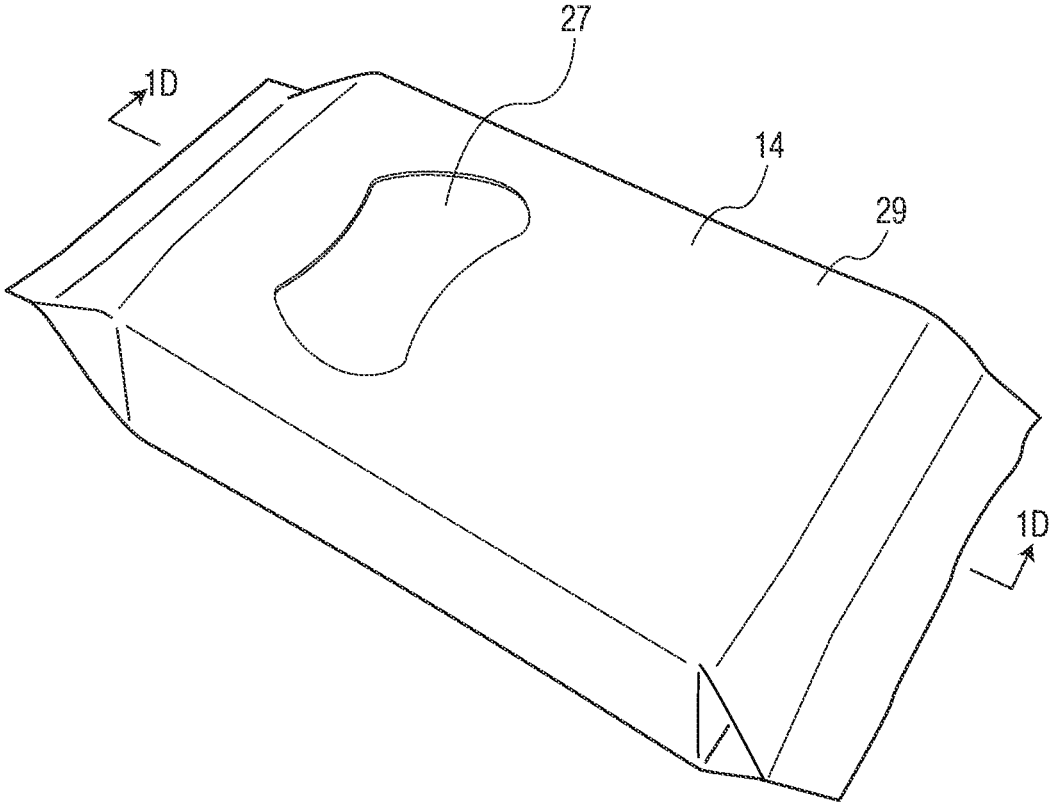
FIG. 1D representatively illustrates a cross-section view taken along line 1D-1D in FIG. 10.
Figure 1D:
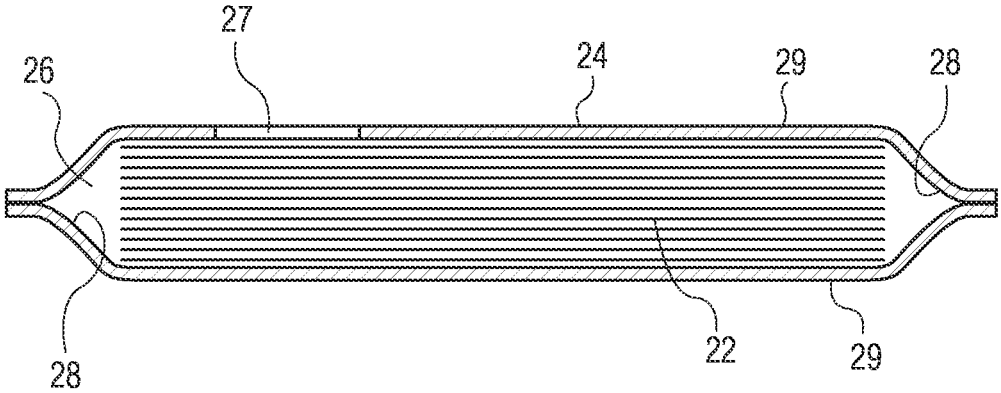
Figure 2:
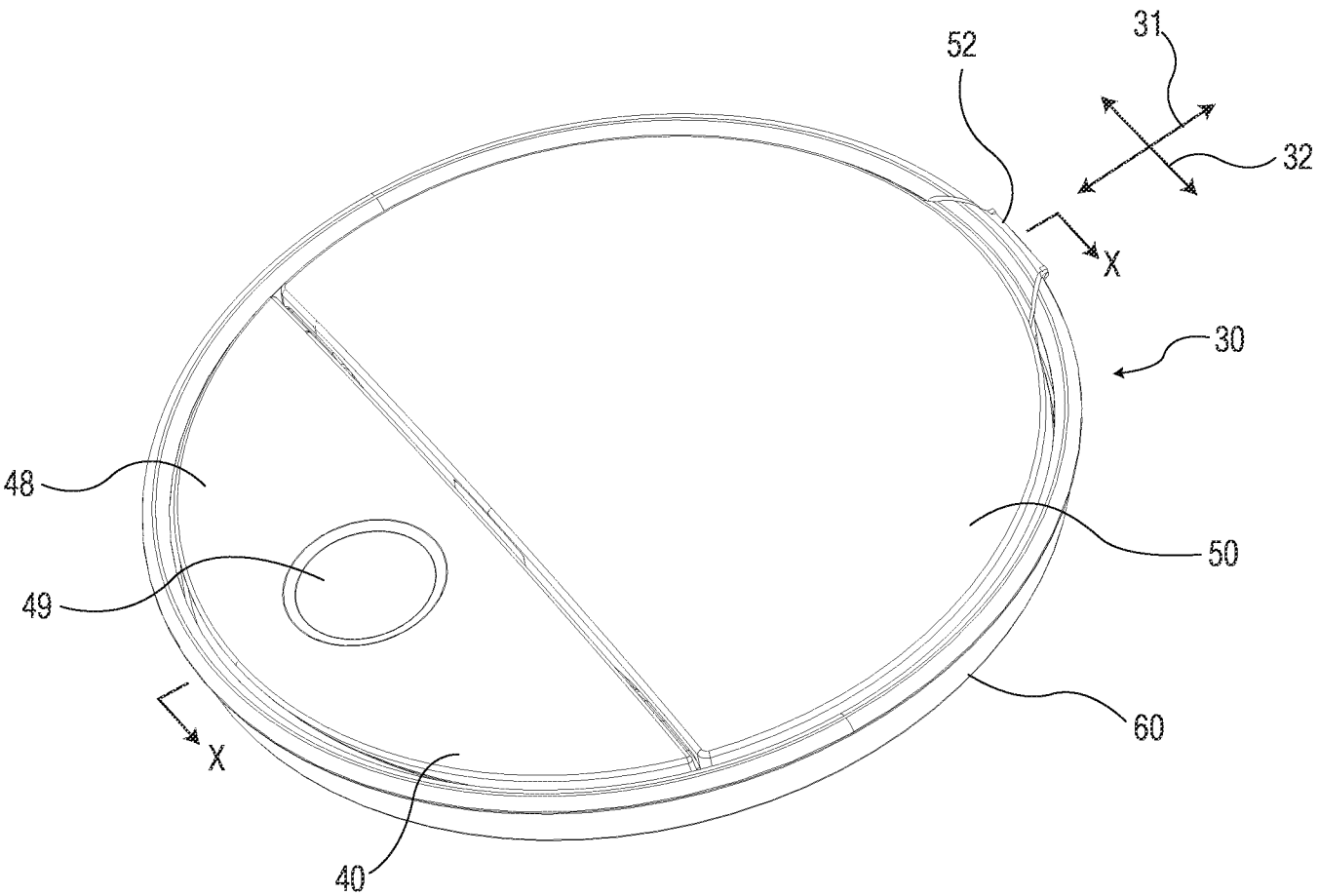
FIG. 2 representatively illustrates a perspective view of one embodiment of the rigid flip top assembly aspect of the present invention.

In particular embodiments, a container 20 is adapted to store and dispense product, such as a stack of moist wipes 22. Other examples of product suitable for use in conjunction with the present invention include facial tissue, sanitizing wipes, paper towels, feminine hygiene products, candy, snacks, or the like. The container 20 includes a housing 14. The housing 14 can be rigid, such as a plastic container (not shown). Alternatively, the housing 14 can be flexible, such as a flexible pouch 24, for storing the stack or roll of wipes 22. The flexible pouch 24 can be made of any suitable flexible substrate, including a polymeric film, a nonwoven fabric, cloth, rubber, foil, or the like. The housing 14 or flexible pouch 24 defines an interior space 26, an inner surface 28 generally facing toward the interior space 26, and an outer surface 29 generally facing away from the interior space 26. The housing 14 or pouch 24 defines a dispensing orifice 27 through which the wipes 22 can be individually extracted from the interior space 26. In particular embodiments, the housing 14 or pouch 24 is substantially moisture-impervious, such as when used to house pre-moistened wipes.

The container also includes a rigid flip top assembly 30. The assembly 30 has a longitudinal dimension 31 and a transverse dimension 32. The assembly 30 includes a lever 40, a lid 50, and a flange 60. The flange 60 is disposed on the outer surface 29 of the housing 14, such as by being affixed to the outer surface 29 of the pouch 24, such as via adhesive. Alternatively, the flange can be integrally formed with the housing 14. The lid 50 covers the dispensing orifice 27 when the lid is in a closed position 33, and the lid 50 exposes the dispensing orifice 27 when the lid 50 is in an open position 34. The lid 50 can optionally include a lid moisture retention ridge 35. Preferably, an entirety of the rigid flip top assembly 30 is disposed outwardly of the dispensing orifice 27 through which the product can be extracted from the interior space 26. If the container 20 is positioned such that the dispensing orifice 27 is facing upward (as representatively shown in FIG. 1A), "disposed outwardly of the dispensing orifice" means disposed above the dispensing orifice 27.

Figure 9:
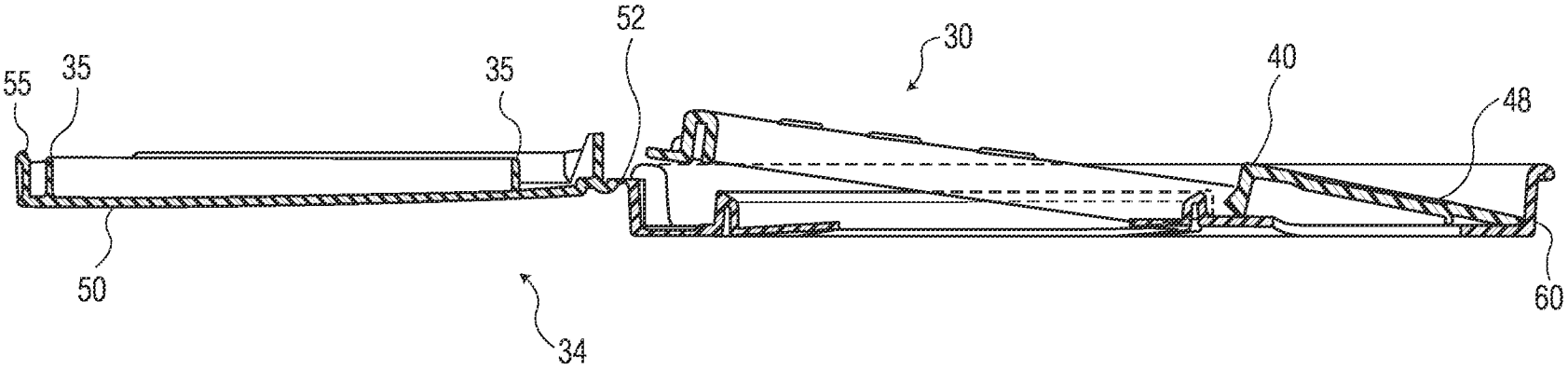
FIG. 9 representatively illustrates a side cross-section view taken along line X-X in the embodiment of FIG. 2, but with the button fully depressed and the lid in a fully open position.

The lever 40 has a first end 41 and second end 42. The lid 50 is connected to the flange 60 at a hinge 52. The hinge 52 is located proximate the second end 42 of the lever 40. The lid 50 is adapted to pivot about the hinge 52 from the closed position 33 (FIG. 5) to the open position 34 (FIG. 9). The flange 60 can optionally include a flange moisture retention ridge 65 that is adapted to seal against the lid moisture retention ridge 35 when the lid 50 is in the closed position 33 (FIG. 5), which helps to seal off the interior space 26, which can be desirable to help prevent the moist wipes 22 from drying out over time.

Referring to FIGS. 3A, 5A-5B, and 6A-6B, in particular embodiments, the flange moisture retention ridge 65 is wider than the lid moisture retention ridge 35. The lid moisture retention ridge 35 seals against a top surface 66 of the flange moisture retention ridge 65, and the top surface 66 is slanted by at least 45 degrees relative to the vertical sides 37 of the ridge 35. In this way, the semi-rigid ridge 35 can "wedge" against the slanted top surface 66 of the ridge 65 when the lid 50 is closed to ensure a tight moisture seal.

Figure 7A:
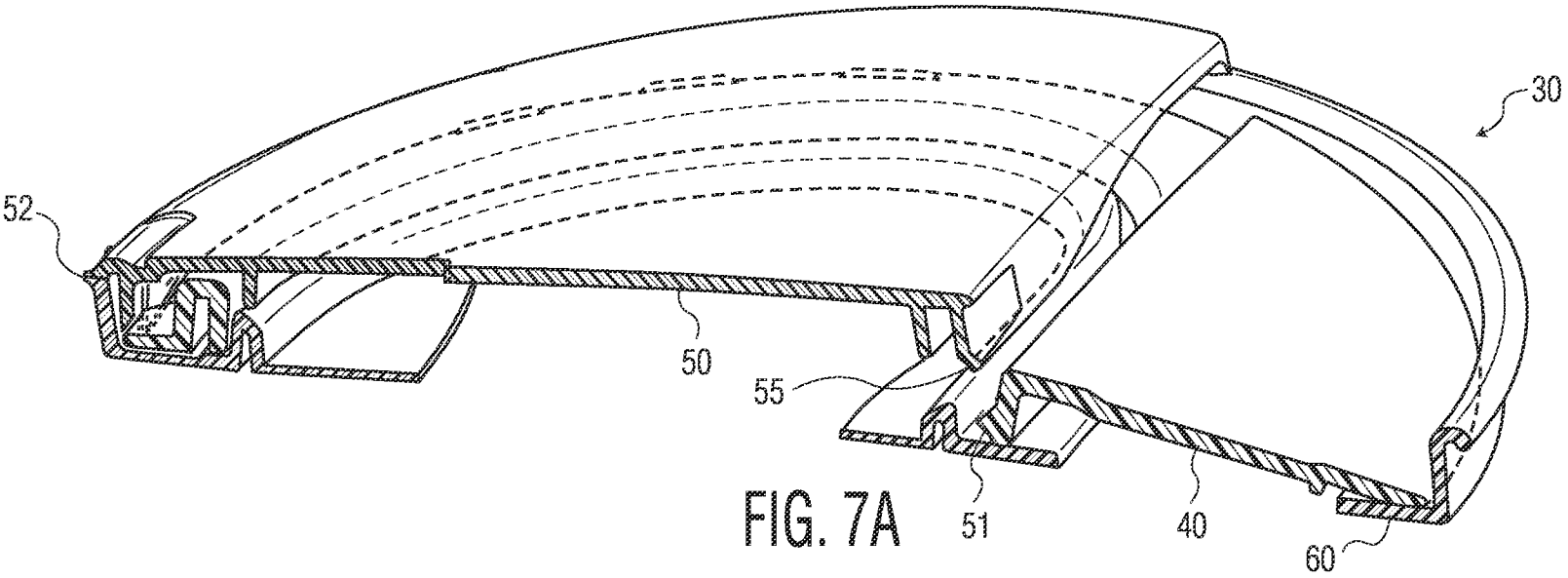
FIGS. 7A and 7B representatively illustrate a perspective cross-section view and a side cross-section view, respectively, taken along line X-X in the embodiment of FIG. 2, but with the button fully depressed and the lid in a released position.
Figure 7B:
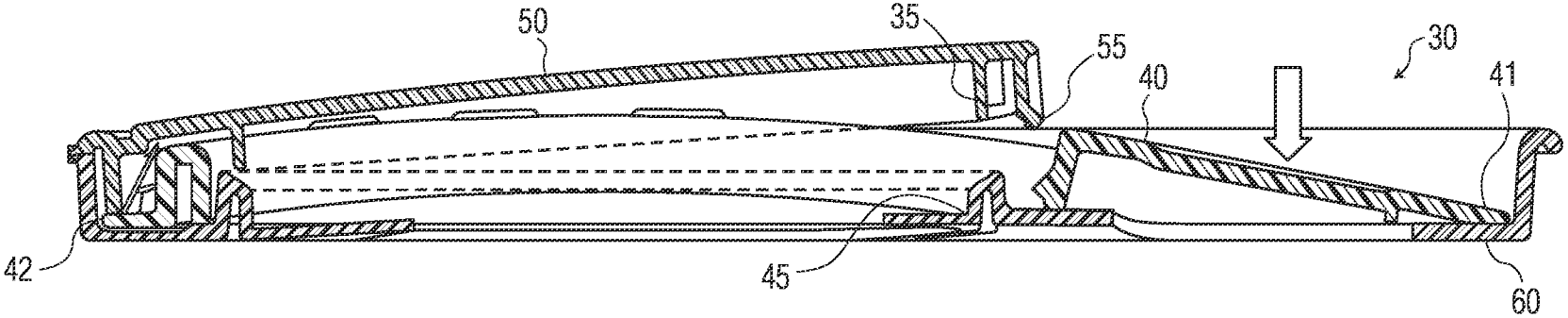
Figure 8:
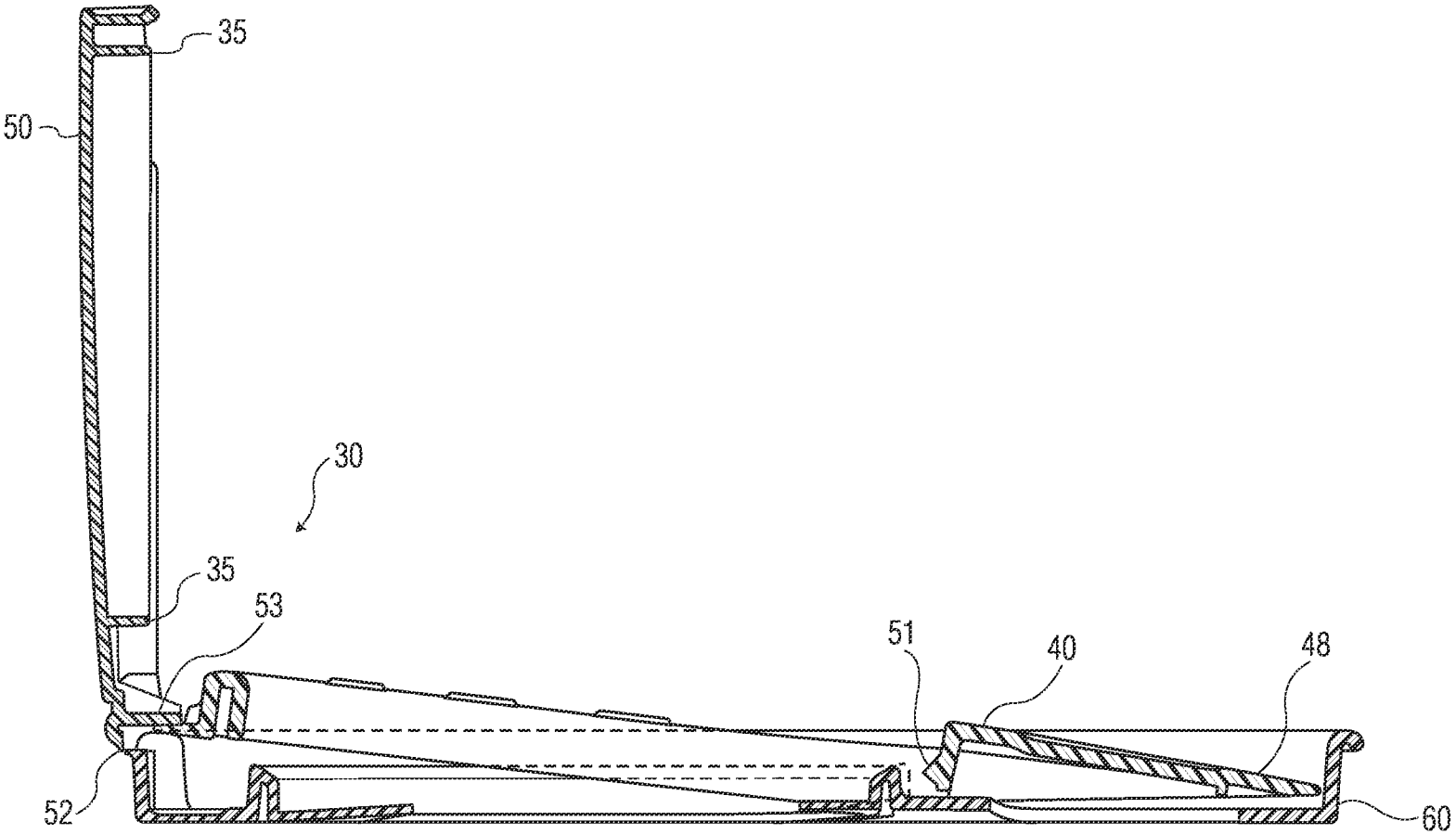
FIG. 8 representatively illustrates a side cross-section view taken along line X-X in the embodiment of FIG. 2, but with the button fully depressed and the lid positioned at roughly 90 degrees to the flange.

The lever 40 extends in the longitudinal direction 31 over a fulcrum 44. When a force is applied to the lever 40 proximate the first end 41 so as to move the lever 40 down toward the flange 60, the lever 40 pivots at the fulcrum 44 about a pivot axis 45, and the second end 42 of the lever 40 moves up and away from the flange 60, and moves the lid 50 from the closed position 33 toward an open position 34. For example, in the embodiment depicted in the Figures, the lever 40 includes a lip 46 proximate the second end 42 of the lever 40. When the second end 42 of the lever 40 moves up and away from the flange 60, the lip 46 pushes against a cam 53 that protrudes from the lid 50 proximate the second end 42 of the lever 40 (FIGS. 7-9). The lever 40 can optionally include a push button 48 that is integrally formed with or connected to the remainder of the lever 40. In particular embodiments, the push button 48 includes one or more topographical variations, such as concavity 49 to prevent a human finger or thumb from slipping during depression.

Figure 5A:
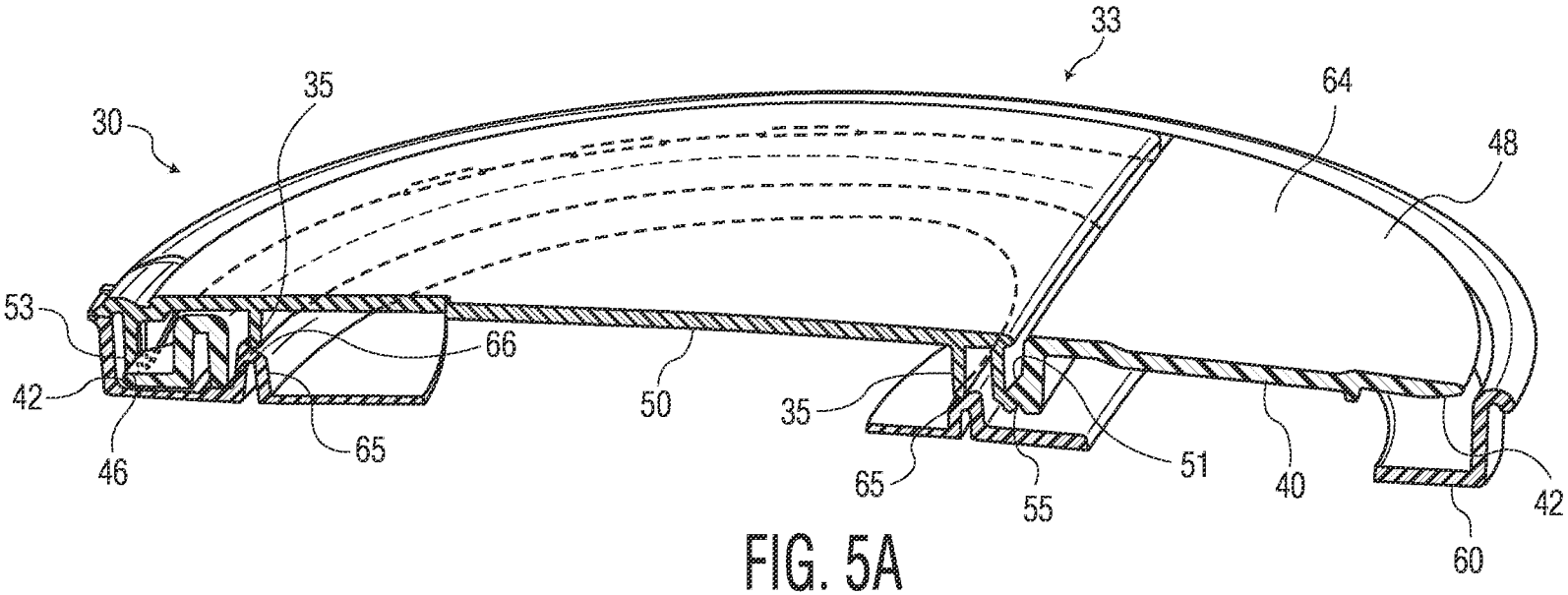
FIGS. 5A and 5B representatively illustrate a perspective cross-section view and a side cross-section view, respectively, taken along line X-X in the embodiment of FIG. 2.
Figure 5B:
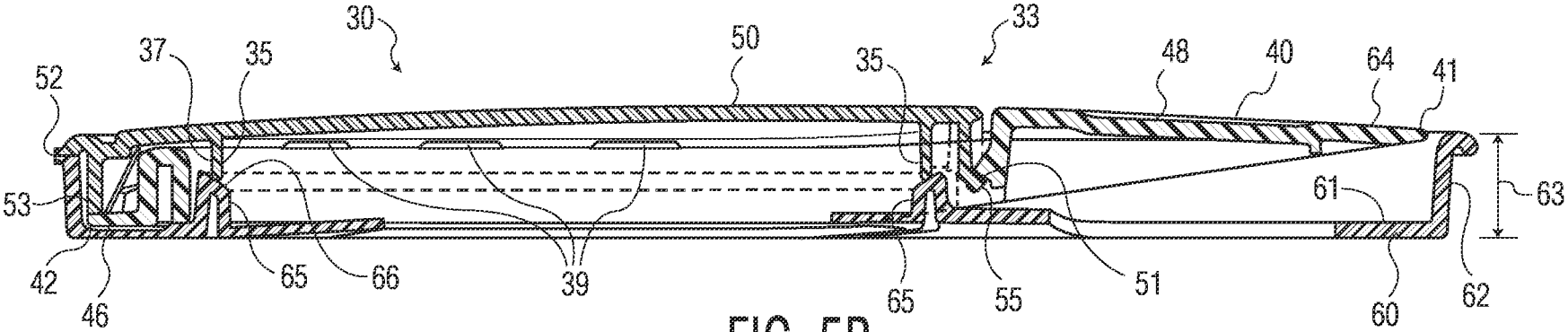
Figure 6A:
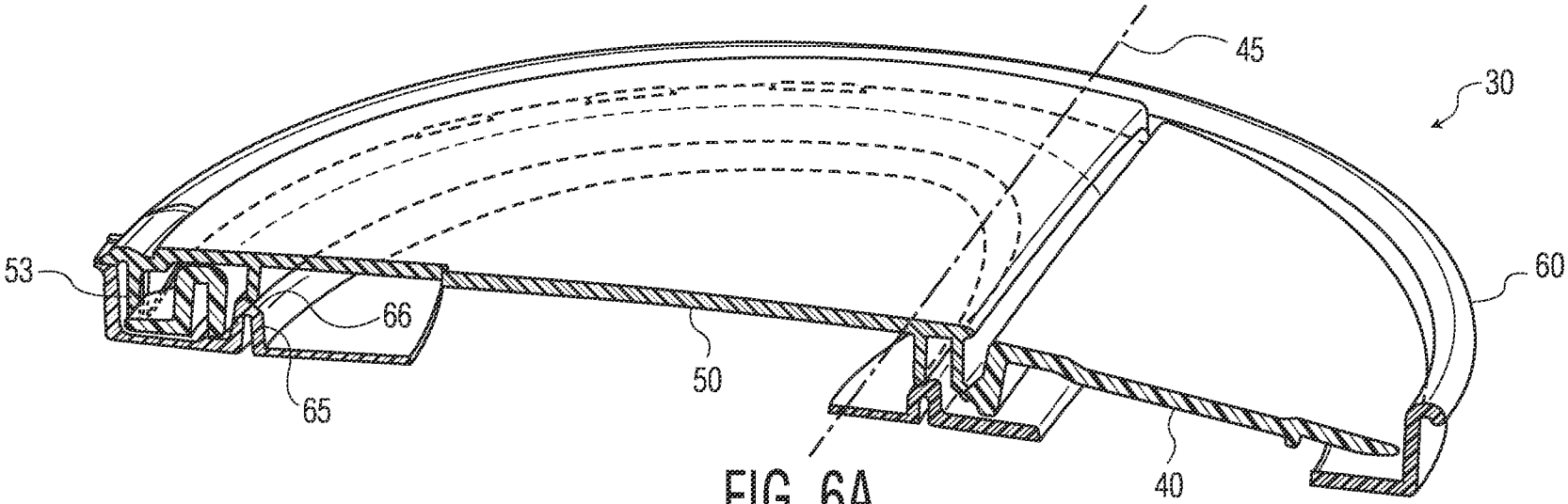
FIGS. 6A and 6B representatively illustrate a perspective cross-section view and a side cross-section view, respectively, taken along line X-X in the embodiment of FIG. 2, but with the button partially depressed.
Figure 6B:
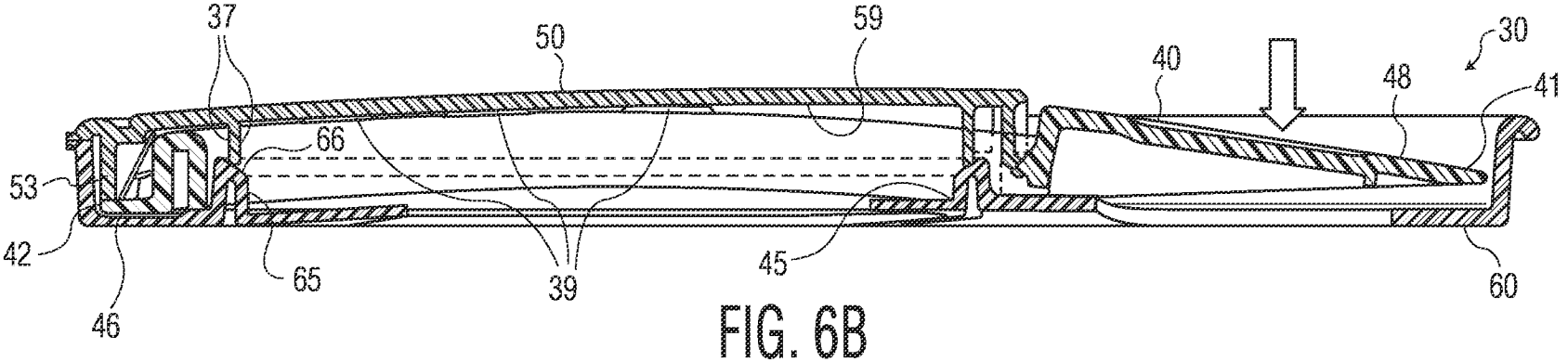

In particular embodiments, as representatively illustrated in FIGS. 5A and 5B, the flange 60 includes a base 61 and a perimeter wall 62 extending upward from the base 61. The perimeter wall 62 extends around at least a portion of the perimeter of the base 61, and in particular embodiments extends around the entire perimeter of the base 61, as shown in the Figures. The perimeter wall 62 has a height 63, measured from the base 61. Preferably, the height 63 of the perimeter wall 62 is at least equal to the height of the push button 48 in those locations where the perimeter wall 62 sits adjacent to the push button 48, as shown in the Figures. "Height of the push button 48" means the distance from the base 61 to the top surface 64 of the push button 48. Configuring the perimeter wall 62 in this way can help to prevent inadvertent depression of the push button 48, and thus prevent inadvertent opening of the lid 50.

Figure 4A:
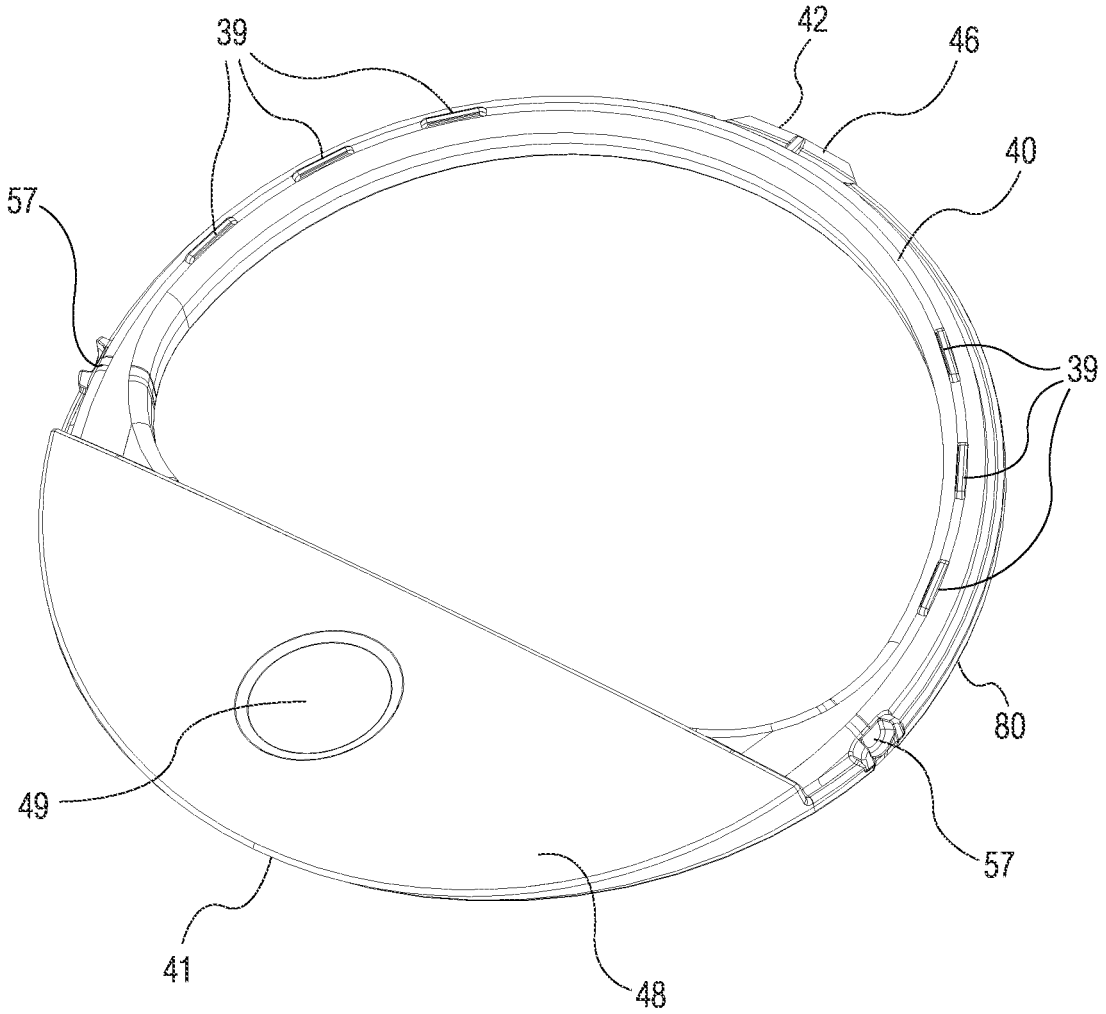
FIG. 4A representatively illustrates a perspective view of the top surface of the lever and button component of the embodiment of FIG. 2.
Figure 4B:
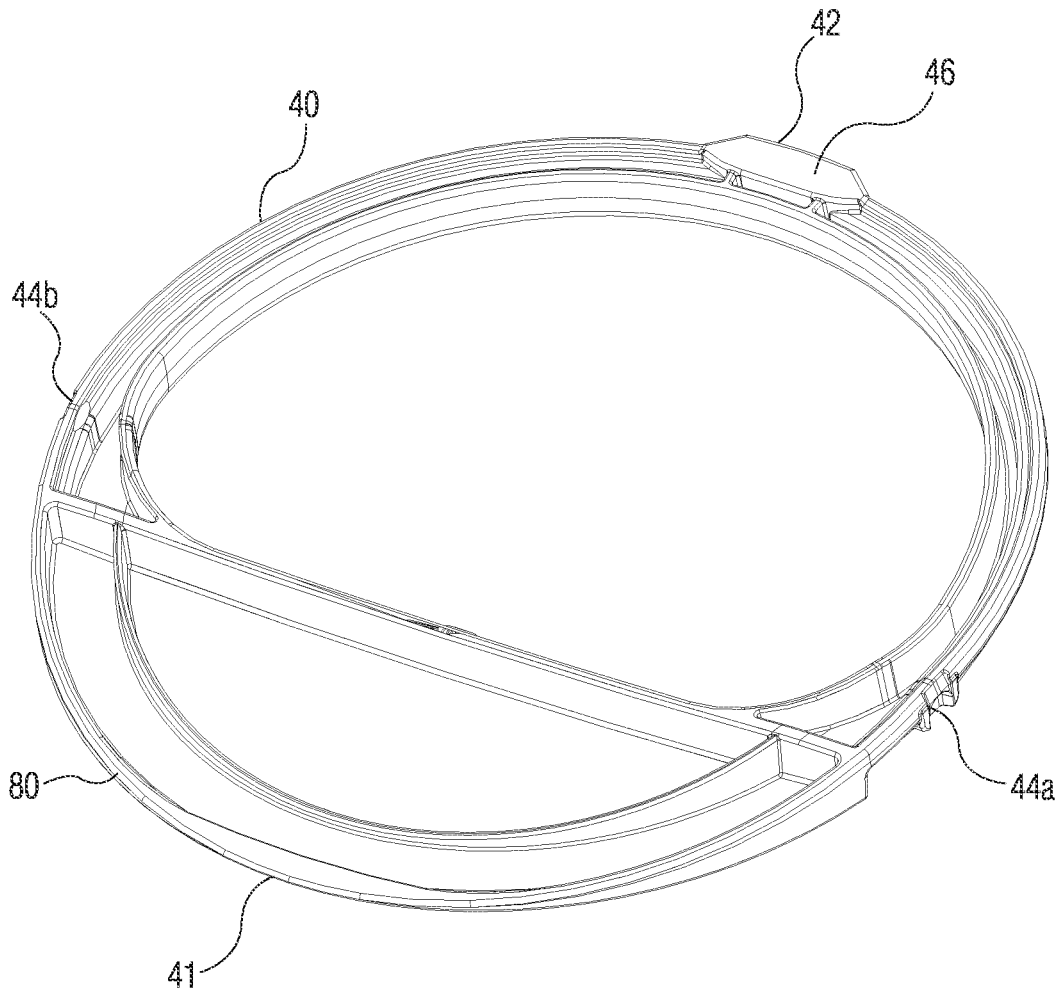
FIG. 4B representatively illustrates a perspective view of the bottom surface of the lever and button component of the embodiment of FIG. 2.
Figure 4C:
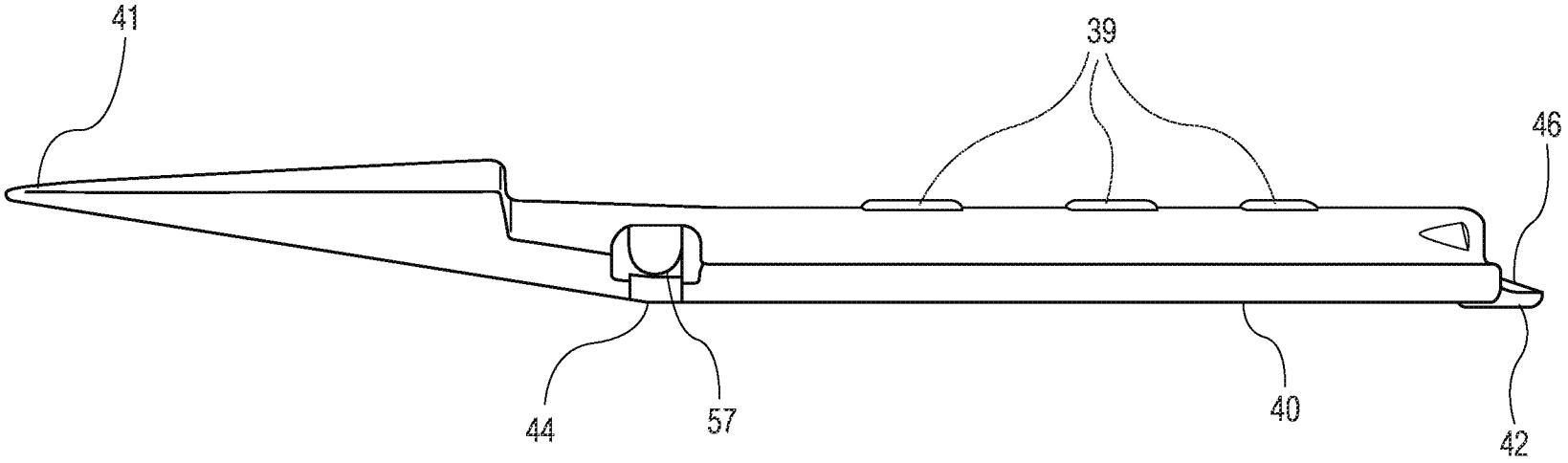
FIG. 4C representatively illustrates a side perspective view of the lever and button component of FIGS. 4A and 4B.

In particular embodiments, the lever 40 is a ring lever 40, as representatively illustrated in the Figures. The ring lever 40 forms the shape of a ring. Preferably, the ring forms a closed loop, although an open loop can be employed. In certain embodiments of the ring lever 40, the fulcrum 44 can be split into two fulcrums 44*a* and 44*b*, as representatively illustrated in FIG. 4B. In particular embodiments, the fulcrum 44 is split into two fulcrums 44*a* and 44*b* that are both integrally formed with the ring lever 40. In particular embodiments, the flange 60 is affixed to the outer surface 29 of the pouch 24, and the ring lever 40 and the flange 60 encircle the dispensing orifice 27.

In particular embodiments, the lid 50 includes a catch 55, and the lever 40 includes a latch 51. The catch 55 is adapted to engage the latch 51 when the lid 50 is in the closed position 33. When a force is applied to the lever 40 proximate the first end 41, the lever 40 attempts to pivot at the fulcrum 44 about the pivot axis 45, as described above. However, the engagement of the catch 55 to the latch 51 prevents the lid from moving, which in turn prevents the cam 53 from moving, which in turn prevents the lip 46 from moving. Thus, the lever 40 begins to bend slightly between the pivot axis 45 and the lip 46, as representatively illustrated in FIG. 6B. As the rigid lever 40 bends, it accumulates potential energy. As the lever 40 is depressed still further via the application of the force, the potential energy continues to build, and the bending lever 40 may begin to push up on the underside 59 of the lid 50, as representatively illustrated in FIG. 6B. Eventually, the upward pressure from the lever on the underside 59 of the lid 50 and/or cam 53, and also optionally the longitudinal movement of the latch 15 away from the catch 55, increases enough to force the catch 55 to pull away from (or push past) the latch 51 (FIG. 7). As the catch 55 is released from the latch 51, the lid is in particular embodiments "flung" from the closed position 33 to a fully open position 34 (FIG. 9).

In particular embodiments, as representatively illustrated in the Figures, the lever 40 includes one or more raised portions 39. The raised portions 39 are designed to more readily urge the lid open when the lever 40 is depressed. Specifically, as the lever 40 is depressed (that is, when the push button 48 is pressed, as the bending lever 40 begins to push up on the underside of the lid 50, the raised portions 39 result in upward pressure being applied on the underside of the lid 50 earlier than if the raised portions 39 were not present, as representatively illustrated in FIG. 6B. In particular embodiments, such a feature (raised portions 39) can result in less polymer being used for the lever. In particular embodiments, the lever includes at least 2, at least 4, or at least 6 raised portions 39.

In particular embodiments, and as representatively illustrated in FIGS. 5-9, as the first end 41 of the lever 40 is moved from a rest position 43 to a fully depressed position 47, the second end 42 of the lever 40 rotates less than 15 degrees, and more particularly less than 10 degrees, about the pivot axis 45, and the lid 50 rotates at least 90 degrees, and more particularly at least 110 degrees, about the hinge 52.

Figure 10:
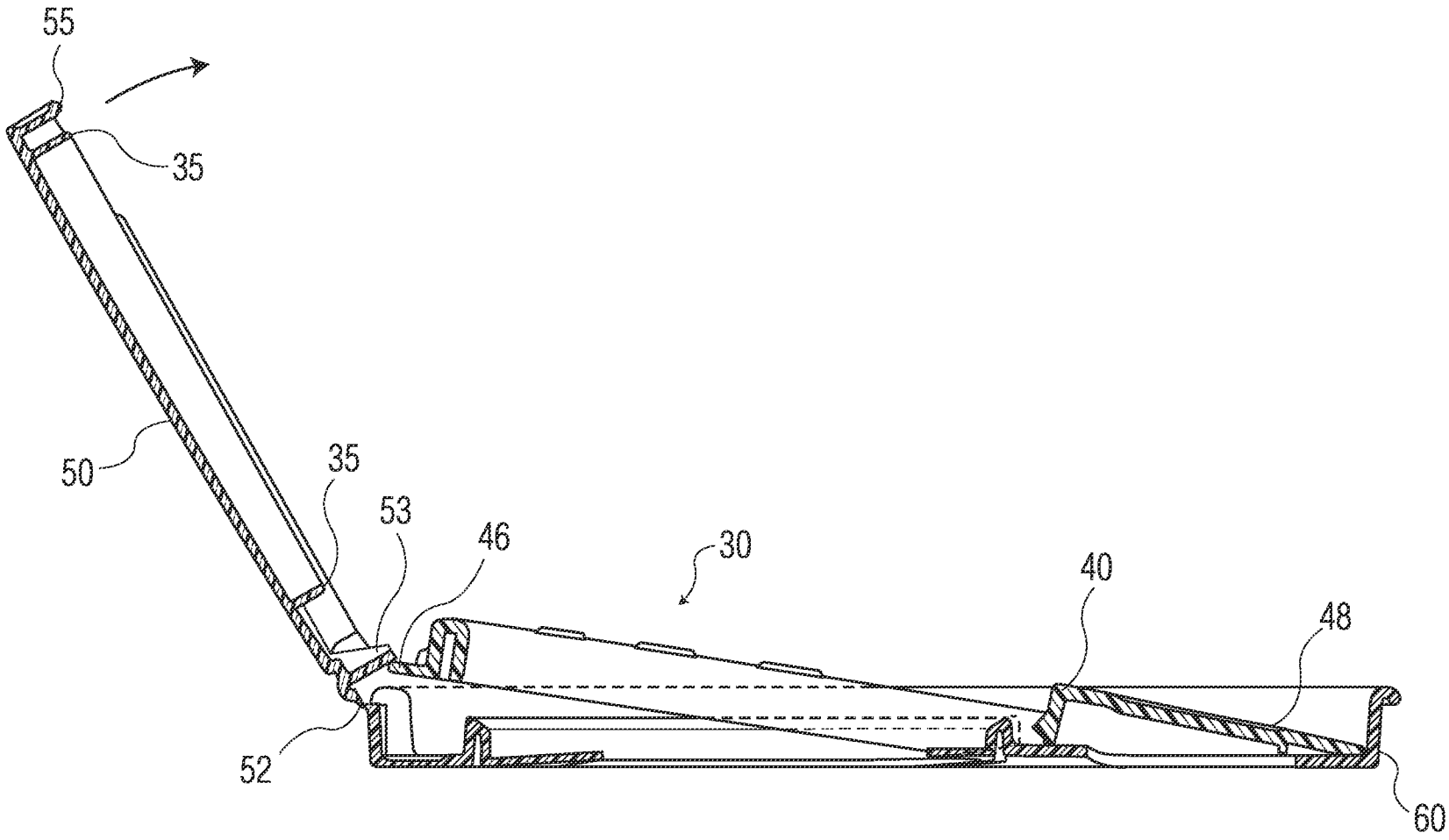
FIG. 10 representatively illustrates a perspective view of the embodiment of FIG. 1A, but with the rigid flip top assembly removed to show underlying features.

Referring to FIG. 10, as the lid 50 begins the path back toward the closed position 33 (as the user manually closes the lid), the cam 53 extends over and pushes down the lip 46, to urge the lever back to a starting position once the lid is "snapped" shut to engage the catch 55 with the latch 51, as representatively illustrated in FIGS. 5A and 5B. This feature can ensure that the push button 48 is automatically reset to the closed starting position, ready to open the lid during the next use.

In particular embodiments, the latch 51 is integrally formed with the lever 40, such as by integrally protruding from the push button 48 as representatively illustrated in FIGS. 5-10. In particular embodiments, the catch 55 is integrally formed with the lid 50, as representatively illustrated in FIGS. 5-10.

In particular embodiments, the fulcrum 44 is closer to the first end 41 than to the second end 42 of the lever 40, as representatively illustrated in FIG. 4C and FIGS. 5-10. In particular embodiments, the fulcrum 44 is integrally formed with the lever 40, as representatively illustrated in FIGS. 5-10.

Referring to FIGS. 3-4, in particular embodiments, the lever 40 includes one or more fittings 57 (shown in the Figs. as female fittings 57) adapted to cooperatively engage with one or more fittings 58 in the flange (shown in the Figs. as male fittings 58). Such engagement assists in securing the lever 40 in place within the flange 60.

Figure 3A:
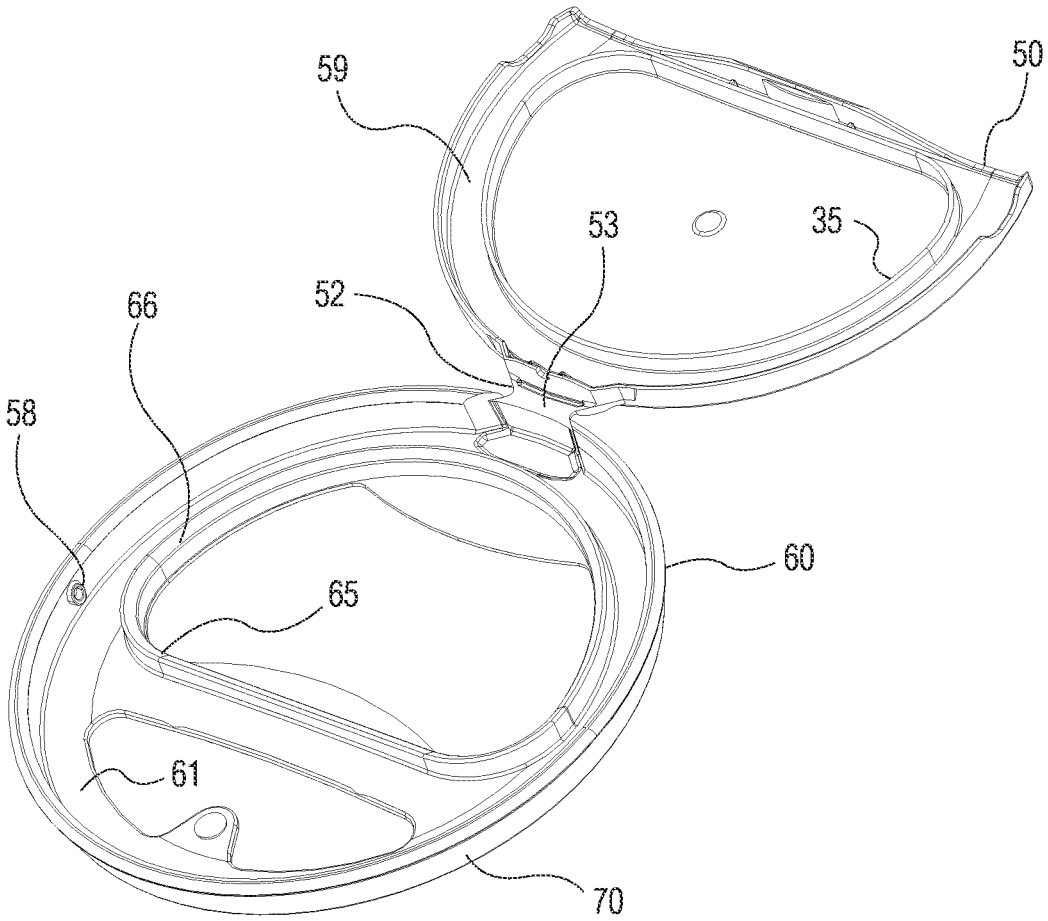
FIG. 3A representatively illustrates a perspective view of the inside surfaces of the flange and lid components of the embodiment of FIG. 2.
Figure 3B:
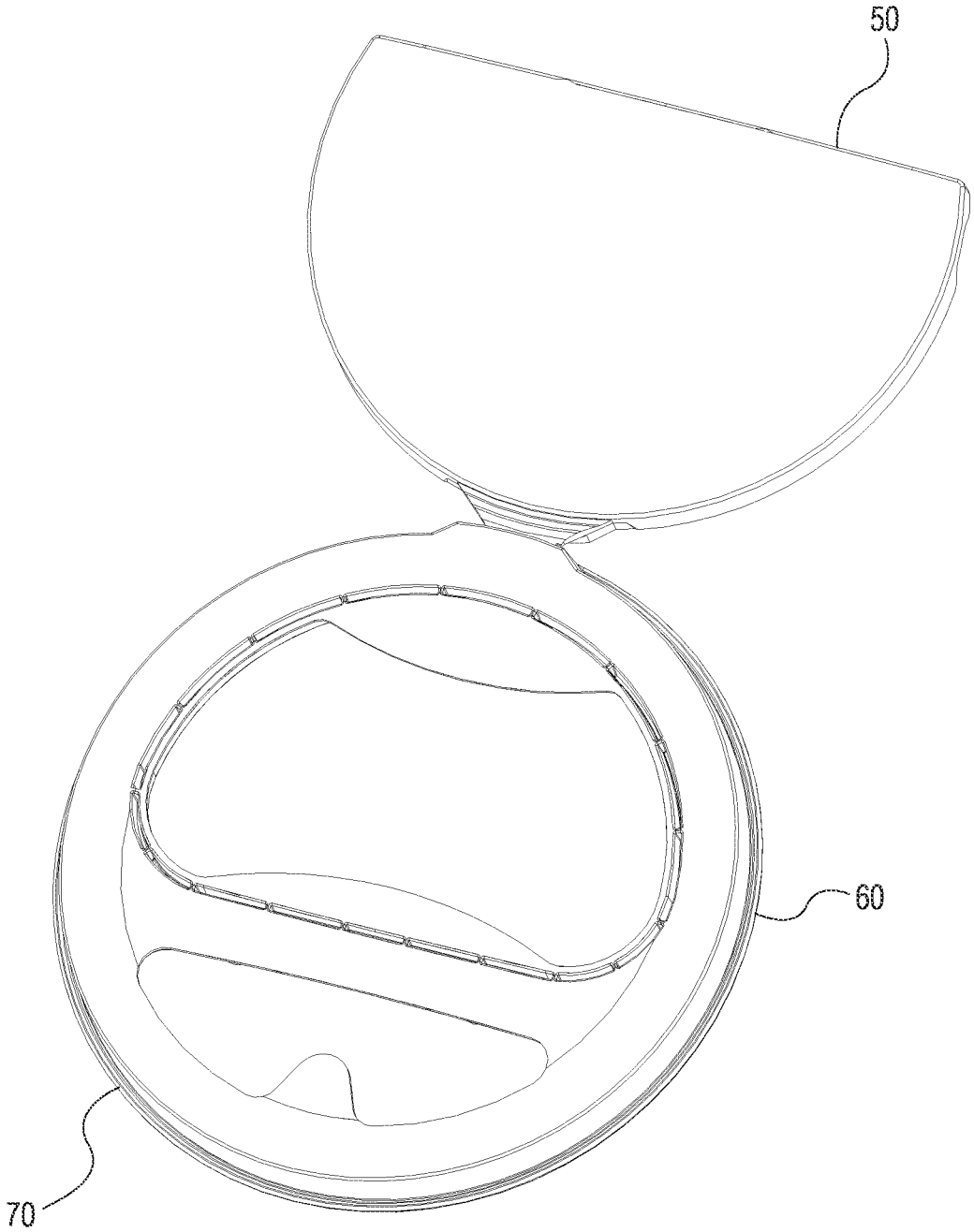
FIG. 3B representatively illustrates a perspective view of the outside surfaces of the flange and lid components of the embodiment of FIG. 2.

In particular embodiments of the container 20, the lever 40, the push button 48, and the fulcrum(s) 44 collectively and integrally form a first component 70 (FIGS. 4A and 4B), and the flange 60, the lid 50, and the hinge 52 collectively and integrally form a second component 80 (FIGS. 3A and 3B). The rigid flip top assembly 30 includes the first component 70 and the second component 80, and no other components. The ability of the particular embodiments of the invention to deliver "spring-open" action via a push-bottom using such a simple two-piece construction, devoid of a separate spring component, can provide an elegant, more easily recycled design having reduced raw material and assembly cost. In other embodiments, all components of the rigid flip top assembly 30 are integrally formed together, such as via injection molding.

In particular embodiments, the invention desirably provides a container having a "pop-open" lid activated by a push button, without the use of a separate and discrete spring, such as a spring made of metal, rubber, silicone, elastomer, or similar highly compressible material. Thus, in particular embodiments, the rigid flip top assembly 30 has a longitudinal dimension and a transverse dimension, and includes a lid 50 and a push button 48. The lid 50 includes a catch 55 adapted to engage a latch 51 when the lid 50 is in a closed position 33. When a force is applied to the push button 48, the lid 50 springs from the closed position 33 toward an open position 34, but the rigid flip top assembly 30, and perhaps even the entire container, includes no component made of rubber, silicone, elastomer, or metal. In particular embodiments, the rigid flip top assembly is made entirely of polymer selected from the group of polyethylene terephthalate, polyethylene, polypropylene, polyamide, polystyrene, polyvinyl chloride, poly acrylo nitrile, and poly carbonate.

In particular embodiments, the rigid flip top assembly (such as the rigid flip top assembly 30 that is affixed to a flexible pouch) is made entirely of material having a flex modulus of 100,000 PSI or greater, such as between 100,000 and 450,000 PSI, as measured by ASTM D 790A. In particular embodiments, the rigid flip top assembly (such as the rigid flip top assembly 30 that is affixed to a flexible pouch) is made entirely of material having a tensile modulus of between 0.1 GPa to 12 GPa, and more particularly from 0.3 GPa to 4.5 GPa. In particular embodiments, the rigid flip top assembly (such as the rigid flip top assembly 30 that is affixed to a flexible pouch) includes no material having a tensile modulus less than 0.1 GPa. In particular embodiments, the rigid flip top assembly 30 includes no component relying upon compressive or tensile energy storage to assist in opening or maintaining closure. Many conventional applications rely on compressed, flexed, or stretched materials (such as rubber) with elastic moduli around 10 to 100 MPa and having a yield strength equal to its ultimate strength allowing it to deform to absorb large amounts of energy due to its ideal elastic properties and regain its original shape to release the energy. Metals such as steel with elastic moduli around 200,000 MPa and yield strength around 250 MPa can also be used to store energy in small changes in shape within its elastic deformation region and then release the energy by rebounding to shape. In particular embodiments, the rigid flip top assembly 30 is made only of polyolefins, such as polypropylene, with an elastic moduli of about 2000 MPa (such between 1800 MPa and 2200 MPa), and a yield strength of about 20 MPa (such as between 15 MPa and 25 MPa). Elastic modulus and yield strength for silicone, rubber, and plastic parts can be measured using ASTM D638.

In particular embodiments, the invention provides a container having a "pop-open" lid activated by a push button wherein, when the lid is in a closed, latched position and the push button is in an un-depressed position, no component in the rigid flip top assembly has stored potential energy.

While the invention has been described in detail with respect to the specific aspects thereof, it will be appreciated that those skilled in the art, upon attaining an understanding of the foregoing, may readily conceive of alterations to, variations of, and equivalents to these aspects.

What is claimed is:

1. A container for storing and dispensing product, the container comprising:

a flexible pouch for storing product, the flexible pouch defining an interior space, the flexible pouch having an inner surface generally facing toward the interior space, and an outer surface generally facing away from the interior space; and a rigid flip top assembly consisting of at least one polymer selected from polyethylene terephthalate, polyethylene, polypropylene, polyamide, polystyrene, polyvinyl chloride, poly acrylo nitrile, and poly carbonate, the assembly having a longitudinal dimension and a transverse dimension, the assembly comprising a lid a push button a ring lever and a flange, wherein the ring lever has a first end and a second end, the lid being integrally connected to the flange at a hinge proximate the second end, the ring lever extending in the longitudinal direction over at least one fulcrum, wherein, when the force is applied to the push button, the ring lever pivots at the fulcrum about a pivot axis such that the ring lever forces the latch to pull away from the catch to move the lid from the closed position toward the open position and wherein the push button is integrally formed with the ring lever;

wherein the lid includes a catch, the catch adapted to engage a latch when the lid is in a closed position, wherein when a force is applied to the push button, the lid springs from the closed position toward an open position.

2. The container of claim 1 wherein the ring lever, the push button, and the at least one fulcrum collectively and integrally form a first component, and wherein the flange, the lid, and the hinge collectively and integrally form a second component, the rigid flip top assembly consisting of the first component and the second component.

3. The container of claim 1 wherein the flange is affixed to the outer surface of the pouch, and wherein the ring lever and the flange encircle a dispensing orifice through which the product can be withdrawn from the interior space.

4. The container of claim 1 wherein, as the first end of the ring lever is moved from a rest position to a fully depressed position, the second end of the ring lever rotates less than 15 degrees about the pivot axis and the lid rotates at least 90 degrees about the hinge.

5. The container of claim 1 wherein, as the first end of the ring lever is moved from a rest position to a fully depressed position, the second end of the ring lever rotates less than 10 degrees about the pivot axis, and the lid rotates at least 110 degrees about the hinge.

6. The container of claim 1 wherein the fulcrum is closer to the first end than to the second end.

7. The container of claim 1 wherein the fulcrum is integrally formed with the ring lever.

8. The container of claim 1 wherein the at least one fulcrum comprises a pair of fulcrums integrally formed with the ring lever.

9. The container of claim 1 wherein as the force is applied to the push button, potential energy builds in the lever while the catch holds the latch in the closed position, and when the latch pulls away from the catch, the potential energy is converted to kinetic energy to cause the lid to spring from the closed position toward the open position.

10. The container of claim 1 wherein the container includes no component made of rubber, silicone, elastomer, or metal.

11. A container for storing and dispensing product, the container comprising:

a flexible pouch for storing product, the flexible pouch defining an interior space, the flexible pouch having an inner surface generally facing toward the interior space, and an outer surface generally facing away from the interior space;

a rigid flip top assembly having a longitudinal dimension and a transverse dimension, the assembly comprising a lid a push button, a ring lever and a flange, wherein the ring lever has a first end and a second end, the lid being integrally connected to the flange at a hinge proximate the second end, the ring lever extending in the longitudinal direction over at least one fulcrum, wherein, when the force is applied to the push button, the ring lever pivots at the fulcrum about a pivot axis such that the ring lever forces the latch to pull away from the catch to move the lid from the closed position toward the open position and wherein the push button is integrally formed with the ring lever;

wherein the lid includes a catch, the catch adapted to engage a latch when the lid is in a closed position, wherein, when a force is applied to the push button, the lid springs from the closed position toward an open position, wherein, when the lid is in the closed position and the push button is in an un-depressed position, no component in the rigid flip top assembly has stored potential energy.

12. The container of claim 11 wherein the container includes no component made of rubber, silicone, elastomer, or metal.

13. The container of claim 11 wherein as the force is applied to the push button, potential energy builds in the lever while the catch holds the latch in the closed position, and when the latch pulls away from the catch, the potential energy is converted to kinetic energy to cause the lid to spring from the closed position toward the open position.

14. The container of claim 11 wherein the rigid flip top assembly consists of polymer selected from the group of polyethylene terephthalate, polyethylene, polypropylene, polyamide, polystyrene, polyvinyl chloride, poly acrylo nitrile, and poly carbonate.

* * * * *